United States Patent [19]

Bloch et al.

[11] Patent Number: 5,061,232

[45] Date of Patent: Oct. 29, 1991

[54] ROLLED PAPER EMBOSSING DISPENSER

[75] Inventors: Nathan D. Bloch, Cherry Hill; Edward J. O'Brien, Eastampton, both of N.J.

[73] Assignee: Scott Paper Company, Philadelphia, Pa.

[21] Appl. No.: 337,058

[22] Filed: Apr. 12, 1989

[51] Int. Cl.[5] ..... B65H 45/12

[52] U.S. Cl. ..... 493/395; 242/55.53

[58] Field of Search ..... 493/395, 400–403; 242/55.2, 55.53; 271/188, 209

[56] References Cited

U.S. PATENT DOCUMENTS

| | | |
|---|---|---|
| Re. 27,453 | 8/1972 | Schutte et al. . |
| 1,224,224 | 5/1917 | Shelley . |
| 2,036,051 | 3/1936 | Kieffer . |
| 2,217,661 | 10/1940 | Anderson . |
| 2,253,718 | 8/1941 | McKeage . |
| 3,045,885 | 7/1962 | Dahlin et al. . |
| 3,083,807 | 4/1963 | Travaglio . |
| 3,133,495 | 5/1964 | De Man . |
| 3,264,978 | 8/1966 | Staley . |
| 3,323,983 | 6/1967 | Palmer et al. . |
| 3,337,388 | 8/1967 | Wosaba, II . |
| 3,379,560 | 4/1968 | Tharp . |
| 3,418,925 | 12/1968 | Wiggins . |
| 3,447,221 | 6/1969 | Odiorne . |
| 3,560,289 | 2/1971 | Otto et al. . |
| 3,616,159 | 10/1971 | Kamp . |
| 3,935,802 | 2/1976 | Perrin et al. . |
| 3,940,529 | 2/1976 | Hepford et al. . |
| 4,000,242 | 12/2976 | Hartbauer . |
| 4,067,509 | 1/1978 | Graham, Jr. et al. . |
| 4,084,500 | 4/1978 | Brown et al. . |
| 4,189,344 | 2/1980 | Busker . |
| 4,192,442 | 3/1980 | Bastian et al. . |
| 4,339,088 | 7/1982 | Niedermeyer . |
| 4,361,085 | 11/1982 | Schutz . |
| 4,378,912 | 4/1983 | Perrin et al. . |
| 4,614,632 | 9/1986 | Kezuka et al. . |

FOREIGN PATENT DOCUMENTS

| | | |
|---|---|---|
| 2177856 | 11/1973 | France . |
| 901387 | 7/1962 | United Kingdom . |

*Primary Examiner*—James G. Smith
*Assistant Examiner*—Jack Lavinder
*Attorney, Agent, or Firm*—John W. Kane, Jr.; Mark G. Bocchetti

[57] ABSTRACT

A rolled paper embossing dispenser comprises a cabinet in which two parallel embossing rollers are rotatably arranged and spring-biased together to define a nip through which a paper web is pulled while being embossed. Each embossing roller comprises a metal axle embedded in a plastic embossing portion. The embossing portion comprises a plurality of axially spaced disks which are axially offset relative to the disks of the other roller. Each disk comprises a plurality of circumferentially successive knuckles interconnected by flats. The knuckles of axially adjacent disks of each roller are circumferentially offset. Both embossing rollers are formed simultaneously in a common mold whereby both plastic embossing portions are subjected to identical molding conditions to achieve identical dimensional tolerances. A threading roller is provided for automatically feeding a paper web into the nip.

33 Claims, 6 Drawing Sheets

129
136
128
120
136
144
122
124
129
140
62
70
72
50
112R
60
130
128
126
48
66
134
80
112F
78
112R
30R
101R
52
56
50
44
74
30F
101F
112F
64
54
80
40
66
78
68
46
132
42
132
58
44
36
38

Fig. 5
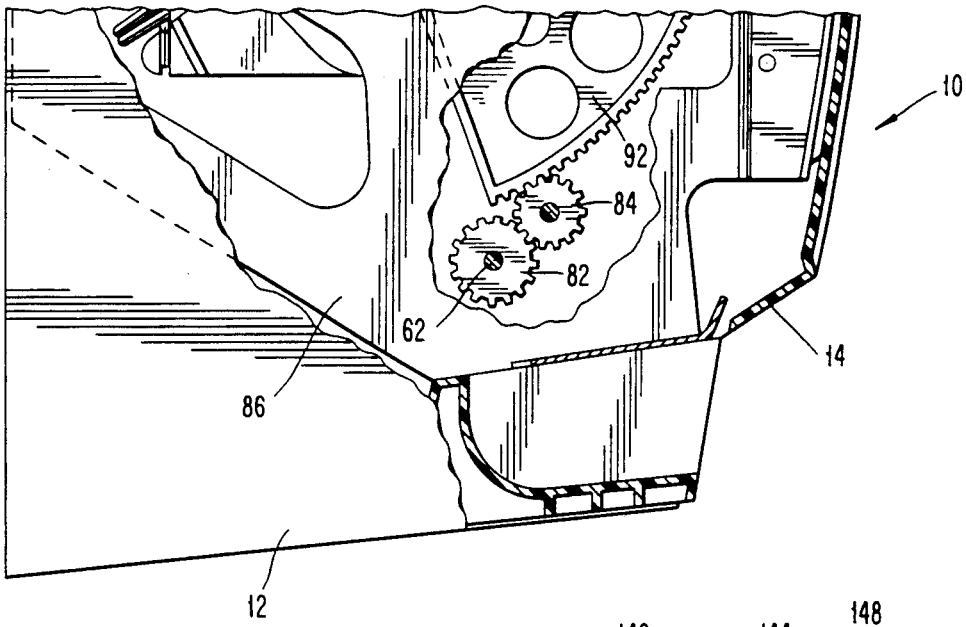
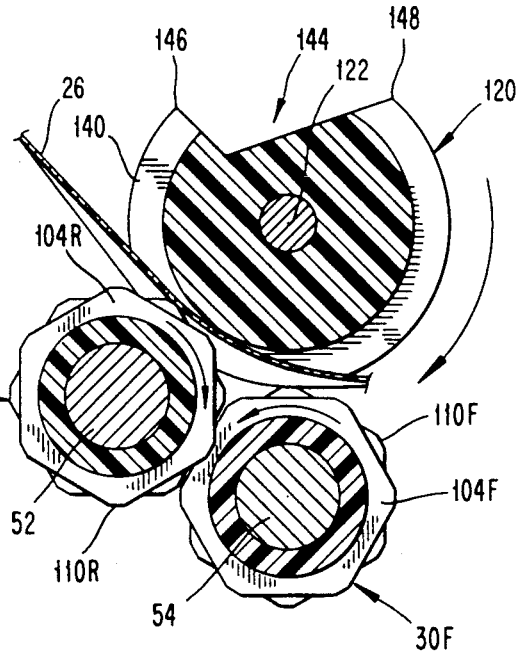
Fig. 3
Fig. 4
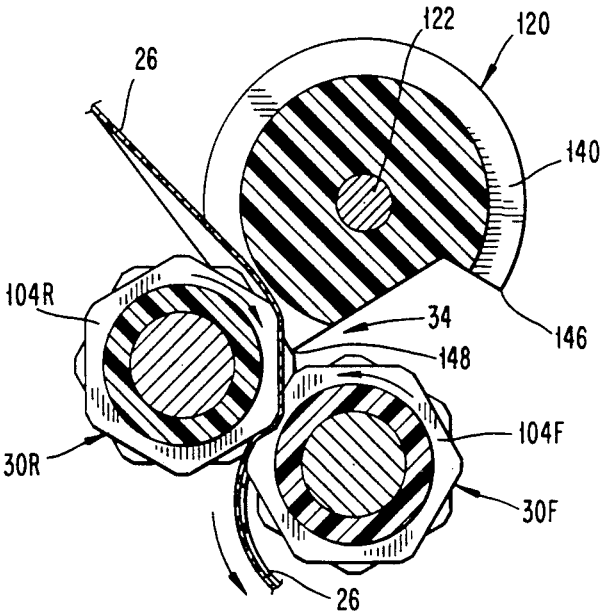

Fig. 12
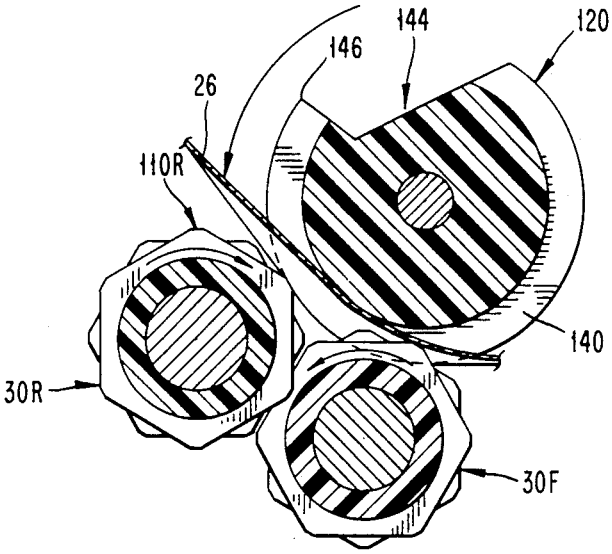
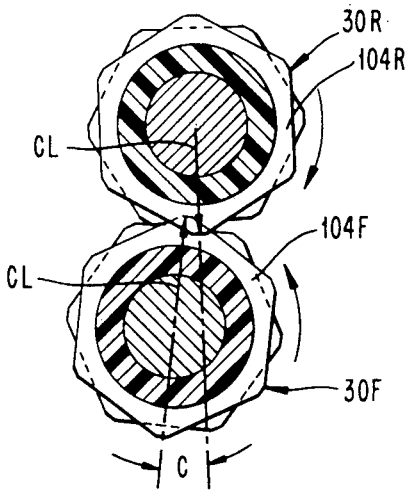
Fig. 15
Fig. 13
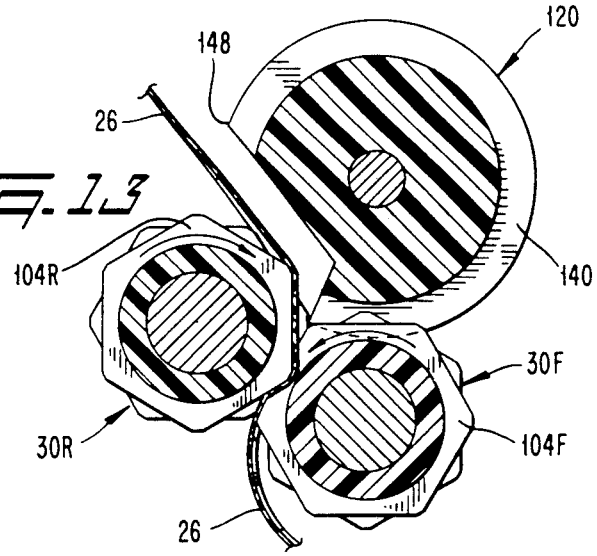
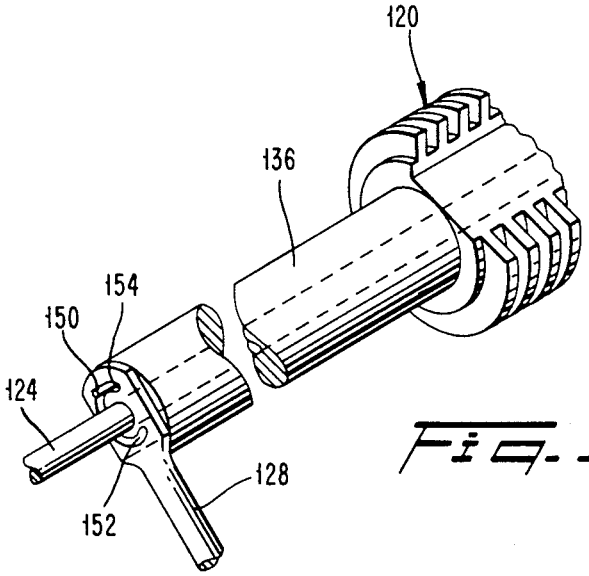
Fig. 14

ROLLED PAPER EMBOSSING DISPENSER

BACKGROUND OF THE INVENTION

1. Field of the Invention

This invention relates generally to a cabinet for dispensing rolled sanitary paper products, and more particularly, to a dispensing cabinet in which a roll of sanitary paper is embossed as it is dispensed.

2. Description of the Prior Art

Rolled sanitary paper products such as paper toweling and toilet tissue are commonly dispensed from cabinets in public washrooms. When economy is a primary consideration, a relatively smooth, flat paper is wound very tightly into a roll to maximize the length of paper for a given diameter of the roll. By maximizing the length of paper on the roll, the roll generally lasts longer which increases the time interval between roll replacements. It is also economical to use lower graded papers, such as unbleached or low brightness papers, in these cabinets. Such economy paper can generally be characterized as dense, stiff and having limited absorbency when compared to higher quality sanitary paper products.

When economy is not a primary consideration and it is desired to provide a higher quality rolled sanitary paper product in the dispensing cabinet, the usual approach has been to soften the paper by pre-treating, usually by embossing and perforating, the paper sheet prior to winding it on a roll. As used in this specification, the term embossing means raising the surface of the paper sheet into bosses or protuberances in such a manner that the length of the embossed sheet is substantially the same as the length of the sheet prior to embossing. Depending on the method of embossing, the length of the embossed sheet can be as much as 5% shorter than the length of the sheet prior to embossing, but more typically is in the range of 0-3% shorter than the length of the sheet prior to embossing. One shortcoming of embossing paper prior to winding it on a roll is that the winding operation flattens the bosses formed in the paper with the result that the dispensed paper has less bulk, softness and absorbency than the embossed paper had prior to being wound on the roll. On the other hand, if the pre-treated, embossed paper is wound loosely on the roll in order to retain the bulk and softness from the embossing process, considerably less footage can be wound on the roll and the dispensing cabinet requires much more frequent servicing.

Another shortcoming of dispensing an embossed paper in roll form, particularly in the case of paper toweling, is the fact that in most rolled towel cabinets, the paper toweling is normally dispensed by compressively passing the toweling through a nip formed by two feed rolls. Shelley U.S. Pat. No. 1,224,224 is representative of such a dispensing cabinet. This compressing of the paper tends to reduce the effects of the prior embossing.

One proposal for improving the quality of rolled sanitary products dispensed from a cabinet is disclosed in U.S. Pat. No. 3,935,802 issued to Perrin et al. In that proposal, the paper web in a dispensing cabinet is passed between a drive roll and a driven roll each rotatable about a fixed axis and having formed on the periphery thereof a multiplicity of generally axially extending and circumferentially adjacent teeth. As the plain or smooth paper toweling web is drawn through and variously compressively abutted between the drive roll teeth and the driven roll teeth, and over the various crests of these teeth, it is intended that the web be foldably deformed into a crimped paper toweling web. The treatment of the paper toweling by the rolls is to be controlled so that the paper web does not undergo any appreciable permanent thickness deformation or permanent compression, and so that there is no sacrifice of moisture strength. One disadvantage of that proposal is that the effective length of the dispensed sheet is inversely related to the gain in bulk achieved by crimping. Another disadvantage is based on the well established fact that for sanitary papers, softness and strength are inversely related and, therefore, any bulking process that maintains the moisture strength of the dispensed sheet results in only slight improvement in sheet softness.

Another proposal for improving the quality of rolled sanitary products dispensed from a cabinet involves the concept of embossing the paper as it is dispensed. An apparatus of that nature is described in copending, commonly assigned U.S. Pat. Application Ser. No. 570,824 of Clarence H. Schatz, filed Jan. 16, 1984. The dispensing cabinet described therein includes a pair of embossing rollers rotatably mounted within the cabinet about stationary parallel axes. Each embossing roller is formed of machined steel and includes a plurality of axially spaced circumferential rows of projections extending radially outwardly from a hub. The projections of each row are circumferentially spaced apart to form gaps therebetween, and each row of projections on a respective roller is circumferentially offset relative to an axially adjacent row. Furthermore, the rollers are arranged such that the rows of projections on each roller are axially offset relative to the projections of the other roller. When the rollers are rotated, each of the projections on a respective roller travels closely adjacent a corresponding projection on the other roller and in radially overlapping relationship therewith to stretch and emboss the paper. As a result, the dispensed paper features an enhanced softness and absorbency. While such an embossing mechanism has performed exceptionally well, room for improvement remains. For example, it would be desirable to minimize the effort required to rotate the rollers during an embossing procedure in order to reduce the manual force necessary to manipulate the roller actuating handle of the dispenser. Also, it would be beneficial to improve the visual appearance of the dispensed paper by resisting the formation of wrinkles therein produced during travel of the web through the embossing nip. It would also be desirable to improve the tracking behavior of the paper by enhancing the extent to which the embossing rollers control the direction of travel of the paper through the embossing nip. Further benefits would result if the rollers could be manufactured more economically, e.g., by forming the parts at least partially of plastic, while maintaining acceptable dimensional tolerances of each roller and proper positional relationships between the assembled pair of rollers.

It will be appreciated that the technology of embossing paper webs has been extensively developed in the case of high speed embossing mills in which paper webs are continuously embossed by polished, machined steel rollers rotatable about stationary axes and having embossing projections which mesh at close tolerance to shear the paper fibers as a tensioned web is pulled rapidly through the embossing nip. However, the technological advancements achieved in the case of such mills are not directly transferable to a manually actuable embossing dispenser wherein the force required to rotate the rollers must be minimized to facilitate manual actuation and wherein manufacturing costs must be held down to enable the dispenser to be affordable to the end user. Furthermore, it is difficult to establish and maintain sufficiently precise tolerances within the embossing nip of a wall-mounted, manually actuable paper dispenser to the extent necessary to enable mill-type embossing techniques to be utilized therein.

SUMMARY OF A PREFERRED EMBODIMENT OF THE INVENTION

The present invention involves a roller paper embossing dispenser comprising a cabinet, a holder for rotatably supporting a roll of paper in the cabinet, and a pair of embossing rollers rotatably mounted in the cabinet. The embossing rollers form a nip therebetween through which the paper is discharged from the cabinet. The embossing rollers have parallel longitudinal axes spaced apart by a selected minimum spacing. Each embossing roller comprises a plurality of axially spaced hub portions having an outer periphery whose shortest distance from the respective axes defines a first distance. A plurality of axial spaced disk portions is disposed between the hub portions and defines recesses between one another. Each disk portion includes a plurality of circumferentially successively arranged knuckles having radially outermost peripheral surfaces. A shortest distance from the respective axes to each knuckle peripheral surface defines a second distance which is longer than the first distance. A plurality of interconnecting surfaces is arranged to interconnect circumferentially adjacent ones of the knuckles. A shortest distance from each inter- connecting surface to the respective axis defines a third distance which is longer than the first distance and shorter than the second distance. Axially successive ones of the disks of each embossing roller are arranged in circumferentially offset relationship. The embossing rollers are arranged such that the disks of each embossing roller are situated radially opposite the recesses of the other roller, and such that the second distance is greater than one-half of the spacing between the axes, and the third distance is no greater than one-half of the spacing between the axes A manually actuable handle is provided for rotating the embossing rollers in unison whereby a paper web passing through the nip is pushed by the knuckles into recesses situated radially opposite the knuckles in a manner stretching the paper and forming embossments therein.

Another feature of the invention relates to an embossing roller per se, which comprises a metal axle embedded in a plastic embossing portion. The embossing portion includes a plurality of axially spaced disks, a gear, and a pair of axially spaced depth rings.

A further aspect of the present invention relates to a paper roll embossing dispenser comprising a pair of embossing rollers which define a nip therebetween, and a threading roller having a plurality of axially spaced fingers thereon for feeding a paper web into the nip in response to rotation of the embossing rollers.

Yet another aspect of the invention relates to an arrangement whereas the embossing rollers are angularly offset relative to one another.

A further feature of the invention relates to the embossing rollers being spring-biased together wherein the embossing forces are yieldable.

In another aspect of the present invention, both of a pair of embossing rollers are simultaneously formed in a common mold by embedding a pair of metal axles within plastic embossing portions. The plastic embossing portions are interconnected by runners which are connected to flats of the embossing rollers.

BRIEF DESCRIPTION OF THE DRAWINGS

The objects and advantages of the invention will become apparent from the following detailed description of a preferred embodiment thereof in connection with the accompanying drawings, in which like numerals designate like elements, and in which:

FIG. 3 is a cross-sectional view taken through an assembly of two embossing rollers and a threading roller, at the initiation of a threading operation;

FIG. 4 is a view similar to FIG. 3 at the conclusion of a threading operation;

FIG. 5 is a fragmentary vertical sectional view taken through the cabinet of FIG. 1 depicting a gear drive between a handle and an embossing roller assembly:

FIGS. 12 and 13 are similar to FIGS. 3 and 4, respectively, depicting an alternative functioning of the threading procedure;

FIG. 14 is a fragmentary perspective view of a manner of mounting the threading roller to ensure that the threading technique of FIGS. 12–13 occurs; and FIG. 15 is a view similar to FIG. 8 of an alternative arrangement of the embossing rollers.

DETAILED DESCRIPTION OF A PREFERRED EMBODIMENT OF THE INVENTION

Figure 1:
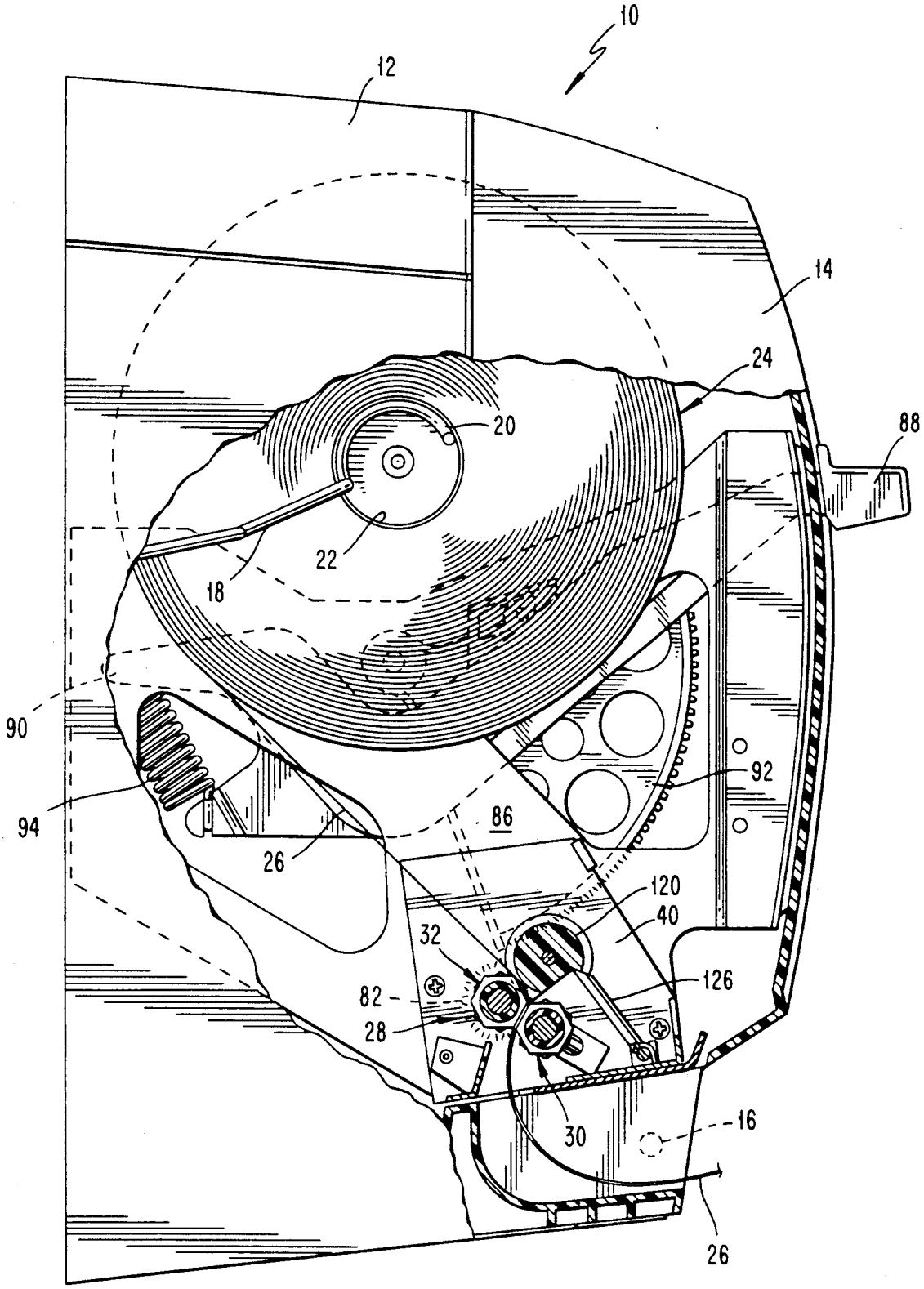
FIG. 1 is a vertical sectional view taken through a rolled paper embossing dispenser according to the present invention.
Figure 2:
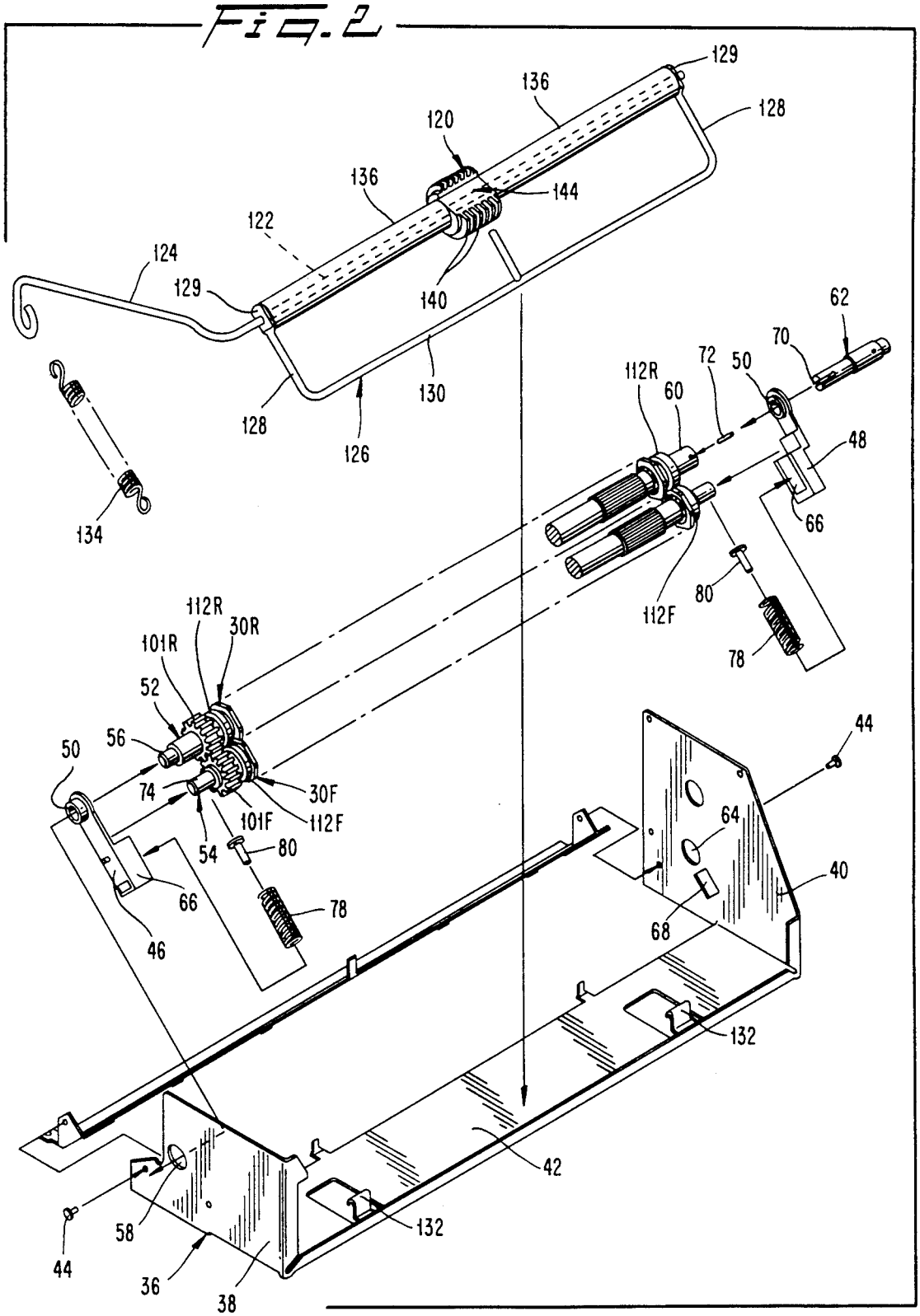
FIG. 2 is an exploded perspective view of components of the dispenser depicted in FIG. 1.

A dispensing cabinet 10 for dispensing rolled sanitary paper in accordance with the present invention is depicted in FIGS. 1 and 2. The cabinet, which can be of a conventional design, comprises a base 12 adapted to be affixed to a wall, and a cover 14 mounted to the base 12. The cover 14 is adapted to be swung downwardly about a horizontal pivot 16 to expose the interior of the cabinet.

Mounted inside the cabinet is a roll holder in the form of a pair of wire members 18 (only one shown) affixed to a back wall of the base and having forward free ends 20 thereof configured to fit into the ends of a roll core 22. The core 22 is disposed within a roll 24 of paper and is adapted to rotate about a horizontal axis defined by the free ends 20 of the wire members, when a pulling force is applied to the paper web 26.

Pulling forces are applied by means of a manually driven embossing mechanism 28 situated adjacent a lower front end of the base 12. The embossing mechanism comprises a pair of parallel front and rear embossing rollers 30F, 30R. The front embossing roller 30F has its longitudinal axis situated forwardly and downwardly relative to the longitudinal axis of the rear embossing roller 30R, although other arrangements of the rollers are possible. The rollers 30F, 30R define therebetween a nip 34 (FIG. 3) in which the paper web 26 is to be pinched and fed while being simultaneously embossed. The rollers 30F, 30R form part of a module which is attached within the cabinet base 12. That module comprises a U-shaped frame 36 (FIG. 2) having a pair of upright legs 38, 40 interconnected by a horizontal bight portion 42. Rivets 44 are employed to attach the frame 36 to the cabinet base 12.

Two axle holders 46, 48 are mounted in respective ones of the frame legs 38, 40. Each holder 46, 48 is formed of a low friction material and includes a hole 50 rotatably mounting an axle of the rear roller 30R. As will be explained in greater detail hereinafter, the rollers 30F, 30R include metal axles 52, 54, respectively. One end 56 of the rear axle 52 is received in the hole 50 of one of the holders 46, and in an aligned hole 58 formed in the frame leg 38. The other end 60 of the rear axle 52 is hollow and receives one end of a drive shaft 62 which projects through aligned holes 50, 64 in the other holder 48 and its associated frame leg 40.

The portion of the holder 48 which includes the hole 50 is situated outside of the frame leg 40, whereas a socket portion 66 of that holder projects through an aperture 68 in the frame leg 40 so as to be disposed within the frame 36. The drive shaft includes a slot 70 which receives a pin 72 passing diametrically through the hollow end 60 of the rear axle 52 to enable the drive shaft 62 to impart rotation to the rear axle 52.

A socket 66 is formed in each of the holders 46, 48. Seated within the sockets 66 are the ends 74, 76 of the front axle 54. Compression springs 78 are disposed in the sockets and are adapted to impart an upward and rearward bias to the axle ends 74, 76 through intermediate pins 80 seated in the springs. Thus, the front roller 30F is yieldably urged toward the rear roller 30R by the springs 78 for reasons to be explained hereinafter.

Mounted fixedly on the drive shaft 62 is a driven gear 82 (FIG. 5) situated outside of the frame 36. Meshing with the driven gear is a floating idler gear 84 which is rotatably mounted in a handle carrier 86. Pivotably mounted in the handle carrier is a manually actuable handle or lever 88. The handle 88 is pivotably mounted at 90 to the handle carrier 86 and is adapted to rotate a toothed segment 92 which is in mesh with the idler gear 84. The manner in which the handle 88 rotates the toothed segment 92 is conventional and disclosed in greater detail in Bastian et al U.S. Pat. No. 4,192,442, the disclosure of which is incorporated herein by reference. As disclosed therein the handle is biased to an upward position by a compression spring 94, and the idler gear 84 travels out of engagement with the driven gear 82 during an upward stroke of the handle 88. Therefore, the handle 88 is able to rotate the rear axle 52 to drive the embossing rollers 30F, 30R only during a downward stroke of the handle.

Figure 8:
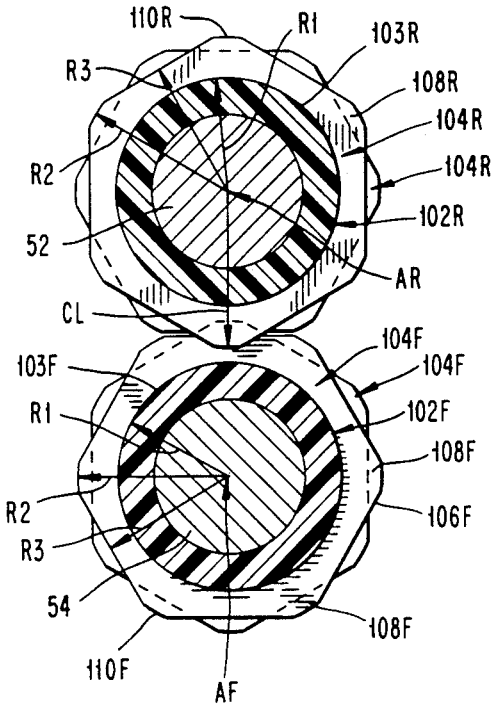
FIG. 8 is a vertical sectional view taken through an embossing roller assembly according to the present invention.

Each of the embossing rollers 30F, 30R comprises the afore-mentioned metal axle 52 (or 54), and a plastic embossing portion 100F (or 100R) integrally molded to the axle. Each plastic embossing portion 100F (or 100R) includes a gear 101F (or 101R) located at on end of the respective roller. The gears 101F, 101R are adapted to meshingly engage one another for the transmission of rotary force and to maintain the embossing rollers in proper angular relationship relative to one another as will be explained hereinafter. Furthermore, each plastic embossing portion includes a hub 102F (or 102R) and a plurality of axially spaced embossing disks 104F (or 104R) and projecting radially beyond the outer surface 103F (or 103R) of the hub 102F (or 102R). Each of the embossing disks is of non-circular configuration (see FIG. 8), preferably comprising circumferentially spaced knuckles 108F (or 108R). Each knuckle includes an arc-shaped, blunt (non-pointed) outer peripheral surface 110F (or 110R), which peripheral surfaces are interconnected by interconnecting surfaces 106F (or 106R) in the form of linear flats. Thus, it will be appreciated that the hub outer surface 103F (or 103R) defines a first distance R from the axis of rotation AF (or AR) of the respective roller (see FIG. 8). Furthermore, the shortest distance from the outer peripheral surface 110F (or 110R) of a knuckle to the axis defines a second distance R2; and the shortest distance from the flat 106F (or 106R) to the axis defines a third distance R3. The third distance R3 is longer than the first distance R1 and shorter than the second distance R2.

Figure 9:
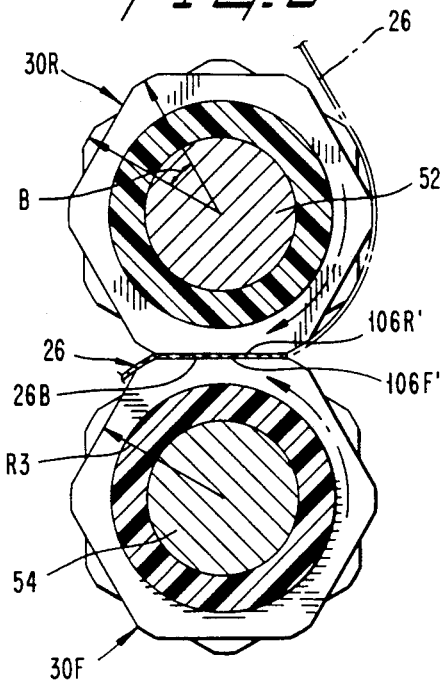
FIG. 9 is a view similar to FIG. 8 with a paper web passing through a nip defined by the embossing roller assembly.

Axially adjacent ones of the embossing disks 104F (or 104R) of each roller are disposed in circumferentially or angularly offset relationship by an angle B (FIG. 9) whose size in degrees is defined by 360/2n, where n equals the number of knuckles. It has been found that the number of knuckles on each disk should lie in the range of four to six. There are six knuckles in the disclosed preferred embodiment, whereby axially adjacent knuckles will be circumferentially offset by an angle B of about 30 degrees (see FIG. 9).

Figure 6:
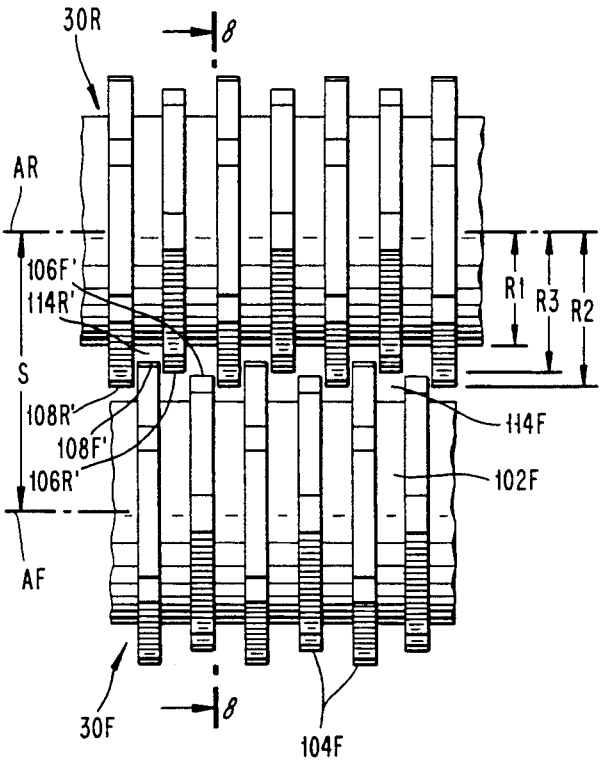
FIG. 6 is a fragmentary elevational view of an embossing roller assembly.

Each of the plastic embossing portions 100F (or 100R) further includes a pair of depth rings 112F (or 112R) disposed at opposite ends of the roller. The depth rings of each roller are adapted to engage the depth rings of the other roller in order to space apart the axes AF, AR of the rollers 30F, 30R by a predetermined minimum spacing S (FIG. 6). The spacing S is chosen such that the second distance R2 of each of the embossing disks 104F, 104R is greater than one-half of the spacing S (i.e., $R2>S/2$), and the third distance R3 is not greater than one-half of the spacing S (i.e., $R3\leqq S/2$). Furthermore, the sum of the second and third distances R2 and R3 is greater than the spacing S (i.e.,$(R2+R3)>S$).

The plastic embossing portions 100F, 100R are of substantially identical configuration, except that the disks 104F, 104R of each roller are axially offset relative to the disks of the other roller when the gears 101F, 101R are in meshing engagement. The amount of axial offset is one-half of the axial spacing between adjacent disks. Thus, within the nip 34, the disks of each roller will be disposed radially opposite recesses or grooves 114F (or 114R) formed by adjacent disks of the other roller.

Figure 7:
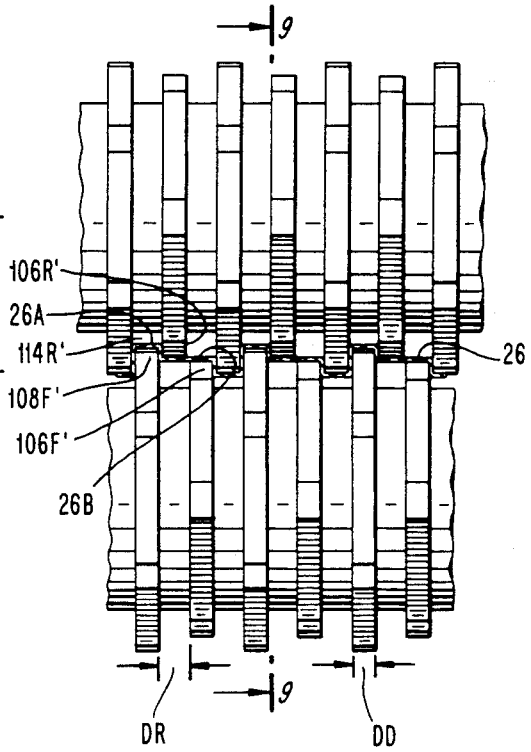
FIG. 7 is a view similar to FIG. 6 with a paper web disposed within a nip of the embossing roller assembly.

As the rollers rotate, the recesses of each roller will lie radially opposite a knuckle—then a flat—then a knuckle, etc., of the other roller. Thus, when axially alternate recesses of a first of the rollers are situated opposite knuckles of the second roller, the remaining recesses of the first roller will be situated opposite flats of the second roller, as depicted in FIGS. 6 and 7.

More specifically, when a knuckle of the first roller is situated radially opposite a recess of the second roller, that knuckle will be disposed axially between the knuckle and flat of the second roller which define the recess. Thus, as can be seen in FIG. 6, the knuckle 108F' of the roller 30F lies axially between the recess-defining knuckle 108R' and flat 106R' of the roller 30R. Since $R2>S/2$, it is assured that the two opposing knuckles 108F' and 108R' will radially overlap one another during an embossing operation. Furthermore, since $(R3+R2)>S$, the knuckle 108F' and the flat 106R, will also radially overlap one another during an embossing operation.

When a recess of a first roller is situated opposite a flat of the second roller at the nip 34, that flat will lie between a knuckle and a flat of the first roller. Thus, as can be seen in FIG. 6, the flat 106R' of roller 30R lies between a knuckle 108F' and flat 106F' of the roller 30F. Since $R3<S/2$, the two flats 106F', 106R' will not radially overlap one another.

The significance of the above-described relationship between the knuckles and flats of the roller pair will now be explained with reference to a paper web 26 passing through the nip 34. The radially overlapping relationship between radially opposing knuckles causes the web to be pushed into the recesses occupied by the knuckles. Thus, as depicted in FIG. 7, the knuckle 108F' pushes a portion 26A of the web 26 into the recess 114R' to stress the paper fibers. This stressing of the paper web occurs, preferably accompanied by a slight tearing of the paper, since a portion 26B of the paper web situated in the web immediately axially adjacent one side of the stressed portion is not being stressed and thus can be pulled toward the recess where stressing is occurring.

The stressing of the paper web within the recesses results in the formation of well-defined embossments in the web. One side of each embossment is formed by the overlapping knuckles, and the other side of the embossment is formed by the overlapping knuckle and flat.

Since resistance to roller rotation occurs only in the recesses where the paper is being stressed, such resistance occurs only at alternative recesses, whereby the effort to manually actuate the handle 88 is minimized. The axial width DR of each recess is greater than the axial width DD of each disk. Furthermore, the rollers 30F, 30R are permitted a limited amount of axial play relative to one another, sufficient to enable each disk to move axially from one side to the other of the radially opposing recess. In that fashion, the disks are self-adjustable to a position offering the least resistance to rotation of the rollers. Hence, ease of actuation of the handle 88 is further promoted. Preferably the difference between the widths DA and DD of the recesses and disks is in the range of 20 to 30% of the recess width DA.

In one preferred embodiment of the invention, the embossing rollers have dimensions R1, R2, R3 of 0.25, 0.34, and 0.3125 inches, respectively. The radius of each spacer wheel 112F, 112R is 0.3125 inches, whereby the spacing S between the axes of rotation is 0.625 inches when the gauge rings are engaged. Thus, when a knuckle 108F (or 108R) enters an opposing recess, the knuckle radially overlaps an opposing knuckle by 0.055 inches, and radially overlaps an opposing flat by .0275 inches. A preferred axial width of the disks is 0.06 inches, and 0.8 inches for the recess, whereby there exists 0.02 inches of axial play, i.e., a play representing 25% of the axial width of the recess.

It has been found that the presence of the flats 106F (or 106R) not only assists in forming the embossments in the paper web, but also aids in resisting wrinkling of the paper within the nip 34. Furthermore, the flats enhance the control exerted over the direction of web travel by the embossing rolls to ensure that the web properly tracks the rollers. In addition, the flats serve to rigidify the knuckles and prevent the occurrence of axial or circumferential deflections thereof. As a result of such rigidity, the disks can be formed of a less expensive plastic material rather than an inherently rigid, more expensive material such as metal.

In the arrangement described in connection with FIGS. 3, 4, 12 and 13, the embossing rollers are arranged to rotate in phase. That is, when two opposing knuckles mesh, the radial centerline CL from an axis AR (or AF) to the center of the knuckle surface 110R (or 110F) of one knuckle coincides with the radial centerline of the other knuckle, as viewed in an axial direction (see FIG. 8).

It may, however, be preferable to arrange the embossing rollers in an out-of-phase relationship, as depicted in FIG. 15, wherein the centerlines CL of the knuckles are angularly offset from each other by an angle C. It has been found that such an out-of-phase meshing of the knuckles serves to increase the length of the embossments in the paper while reducing the maximum dimension of radial overlapping of the knuckles. Such a shortening of the radial overlap serves to further reduce the magnitude of the force needed to be applied to the manual actuating handle 88. The size of the angle C should be greater than zero degrees but not greater than 10 degrees, and most preferably is about 7.5 degrees.

The paper embossed and dispensed by the cabinet 10 will feel softer and be more absorbent than the non-embossed paper present on the paper roll 24. As noted earlier herein, more paper is contained in a roll of non-embossed paper than in a roll of embossed paper of the same diameter. Hence, a longer interval between roll replacement is established.

When a paper roll is to be replaced, it is necessary to feed the leading end of the new web into the nip 34 of the embossing rolls. While this task could be performed manually, the present invention envisions the use of a threading roller 120 which automatically feeds or threads the paper web into the nip.

The threading roller 120 (see FIGS. 3 and 4) is freely rotatably mounted on a shaft 122, one end 124 of which is bent to extend rearwardly into the cabinet. A U-shaped rod 126 includes a pair of legs 128 whose ends 129 are rotatably connected to the shaft 122, and a bight portion 130 which is mounted within a pair of ears 132 of the module frame 36. Thus, the bight portion 130 defines a horizontal pivot axis for the rod 126. A compression spring 134 is connected between the frame 36 and a rear end of the shaft portion 124 in such manner as to bias the threading roller 120 toward the embossing rollers 30F, 30R. However, the shaft can be rotated to a position spaced forwardly of the embossing rollers to enable a leading end of the paper web to be pulled to a position in which it overlies the rollers. Two sleeves 136 are freely rotatably mounted on the shaft 122 on opposite sides of the threading roller 120 to generally center the threading roller, while affording the threading roller a slight amount of axial play.

The threading roller 120 includes plurality of axially spaced annular ribs 140 formed integrally with a hub portion 142. Formed in an outer periphery of the threading roller is a notch 144 which extends the entire axial length of the threading roller to circumferentially interrupt the ribs 140. Hence, the ribs define two groups of axially aligned ends 146 and 148.

The ribs are axially spaced apart by a distance corresponding to the axial width DR of the recesses 114F (or 114R), and the axial width of each rib is about the same as the axial width DD of the disks 104F (or 104R). Due to the presence of the notch 144, the threading roller will tend to assume a position in which the notch 144 faces upwardly, i.e., the heavier un-notched portion of the threading roller gravitates to a lowermost position, as depicted in FIG. 4. In such a position, the ribs 140 will be situated opposite the disks 104F (or 104R) of one of the embossing rollers 30F (or 30R) and opposite the recesses 114F (or 114R) of the other embossing roller (since the disks of each embossing roller are axially offset relative to the disks of the other embossing roller as described earlier herein). The axial location of the threading roller 120 on the shaft 122 will determine which set of the roller disks is disposed opposite the ribs 140. As explained below, this will determine the direction in which the threading roller is rotated in response t rotation of the embossing rollers.

The threading roller 120 is intended to function when a paper web disposed between the threading roller and the embossing rollers 30F, 30R has not yet ben threaded into the nip, as depicted in FIG. 3. That is, a leading end of a paper roll 26 has been manually pulled sufficiently far so as to be sandwiched between the threading roller 26 and the pair of embossing rollers. Thereafter, the threading roller 120 is pulled against the embossing rollers by the spring 134. In the relationship depicted in FIG. 3, the ribs 140 of the threading roller are disposed opposite the disks 104F of the front embossing roller 30F and opposite the recesses 114R of the rear embossing roller 30R. Hence, under the action of the spring 134, the ribs 140 press the paper web against the disks 104F. The engagement between the ribs and the knuckles prevents the ribs from fully penetrating the recesses 114R of the rear embossing roller 30R.

When the embossing rollers are then rotated in response to actuation of the handle 88 the threading roller is rotated clockwise (as viewed in FIG. 3) by the counterclockwise rotation of the front embossing roller 30F. Eventually, the ends 148 of the ribs will ride off the disks 104F, enabling the ribs to be pulled more fully into the recesses 114R by the spring 134 (as shown in FIG. 4), whereby the paper web is pushed into pinching relationship with the nip 34. The work of the threading roller 120 is thus finished and it remains idle in the FIG. 4 position during subsequent unwinding of the paper roll by the embossing rollers.

It will be appreciated that since the threading roller 120 is capable of limited axial play, it may occur that instead of the relationship depicted in FIG. 4, the ribs 140 could instead be disposed opposite the disks 104R of the rear embossing roller 30R and opposite the recesses 114F of the front embossing roller 30F, as depicted in FIG. 12. In such a case, the disks 104R will prevent the threading roller from being pulled fully into the recesses 114F. When the embossing rollers are rotated, the clockwise-traveling rear embossing roller 30R produces counterclockwise rotation of the threading roller 120. Eventually the ends 146 of the ribs 140 will ride off the disks 104R, whereupon the threading roller will be pulled fully into the recesses 114F, causing the paper web to be pushed into the nip 34, as depicted in FIG. 13.

It is most preferable that, once threading has been effected, the threading roller 120 occupy the FIG. 13 position as opposed to the FIG. 4 position, because a threading roller oriented as shown in FIG. 13 makes a lesser amount of contact with the paper web than a threading roller oriented as shown in FIG. 14. Thus the threading roller of FIG. 13 offers less resistance to paper travel and thus less resistance to actuation of the handle 88. If it is desirable to ensure such an advantageous positioning of the threading roller, an arrangement such as depicted in FIG. 14 can be employed. In that arrangement, one of the sleeves 136 is fixedly connected at one end to the threading roller 120 and is provided at its other end with an axial projection 150. The projection 150 is slidably received within an arcuate slot 152 formed in the end 129 of a leg 128. The slot is generated as a circular segment about the axis of rotation of the threading roller. The upper end 154 of the slot defines a stop which restricts the extent to which the roller can rotate in the clockwise direction depicted in FIG. 12. Accordingly, the threading roller 120 will be able to rotate to a terminal position only in the counterclockwise direction, i.e., to the terminal position depicted in FIG. 13. Furthermore, the sleeves 136 will be dimensioned to close tolerance in the axial direction to ensure that the ribs 140 of the threading roll 120 will be situated radially opposite the disks 104R so as to be driven in the counterclockwise direction. It is thus assured that, once threading has been achieved, the threading roller 120 will thereafter occupy the FIG. 13 position which offers minimal resistance to actuation of the handle 88.

During a threading operation, it is likely that the paper web will be folded over on itself, whereby a multiple-ply thickness of paper will pass through the nip 34. This thickness could be even greater in the event that a conventional mechanism is utilized wherein a partially exhausted paper roll is mounted in the cabinet in addition to a new roll; in such a case there will occur a situation when sheets from both paper webs temporarily pass through the nip simultaneously.

In order to prevent an excessive resistance to rotation of the embossing rollers, which would seriously diminish the utility of the invention in a manually actuated paper dispenser, the yieldability of the front embossing roller 30F permits tee nip to be enlarged in response to the entry of the enhanced paper thickness. That is, the front embossing roller 30F is displaced forwardly against the bias of the springs 78. Even after the new web has been threaded, and only a single-sheet thickness of paper continues to be fed, it is likely that the front embossing roller 30F will remain displaced away from the rear embossing roller 30R by the presence of the paper in the nip, such that the depth rings 112F, 112R are slightly spaced part. In that event, it will be appreciated that the embossing force equals the combined spring forces. While it has been conventional to urge smooth cylindrical nip rollers together by springs (e.g., see the afore-mentioned Bastian et al U.S. Pat. No. 4,192,442), it has heretofore been the practice to mount paper-deforming rollers on fixed axes so as to maintain a constant pre-set meshing depth between the paper-deforming projections or lands of the two rollers. In the present invention, the meshing depth of the embossing disks is not fixed, but rather is adapted to fluctuate in order to avoid the need to apply an excessive force to the actuating handle 88.

Although the meshing depth is allowed to vary in accordance with the present invention, it is necessary that the embossing rollers 30F, 30R be manufactured within sufficiently close tolerances in order to enable the disks 104F, 104R to properly mesh with one another with sufficient axial spacing whereby the rollers can move axially relative to one another to assume positions creating the least resistance to paper travel. It is also desirable that at least a portion of the rollers, e.g., the embossing portions 100F, 100R of the rollers, be formed of an inexpensive material such as plastic. The most economical way of manufacturing the rollers is a molding operation. However, a molding operation involves certain obstacles to achieving proper dimensional tolerances of the rollers, since the dimensions of molded rollers can vary in response to the very slightest difference in temperature, pressure, molding composition, and shrinkage rate of the plastic, for example. Since it is very difficult to achieve consistency of those parameters from one molding operation to the next, it is possible that embossing rollers formed during separate molding operations may not mate together in an optimum manner.

A further concern involving the formation of embossing rollers of plastic relates to the tendency for objects, such as rollers, supported solely at their ends to sag in the middle. It will be appreciated that such sagging would adversely affect the mating of the rollers.

The above concerns are alleviated by the present invention wherein both of an associated pair of rollers are molded simultaneously in a common mold, whereby both rollers will possess an identical plastic composition formed under identical temperature and pressure conditions. Furthermore, the rollers are formed by molding plastic embossing portions 100R, 100F around a metal shaft or axle 52, 54 which is resistant to sagging. Moreover, each of the plastic embossing portions 100F, 100R comprises separate sections spaced along the shaft to promote a uniform rate of shrinkage of the plastic.

Figure 10:
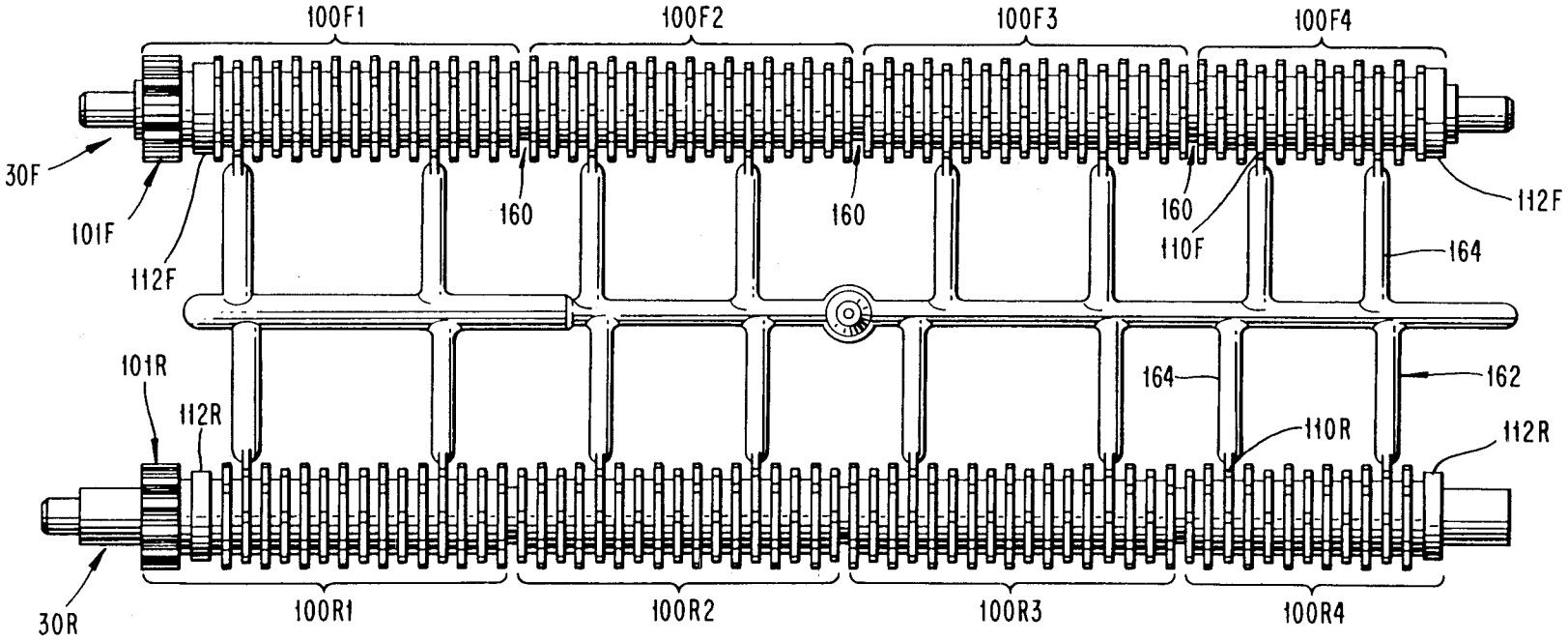
FIG. 10 is a plan view of an embossing roller assembly after removal thereof from a mold.
Figure 11:
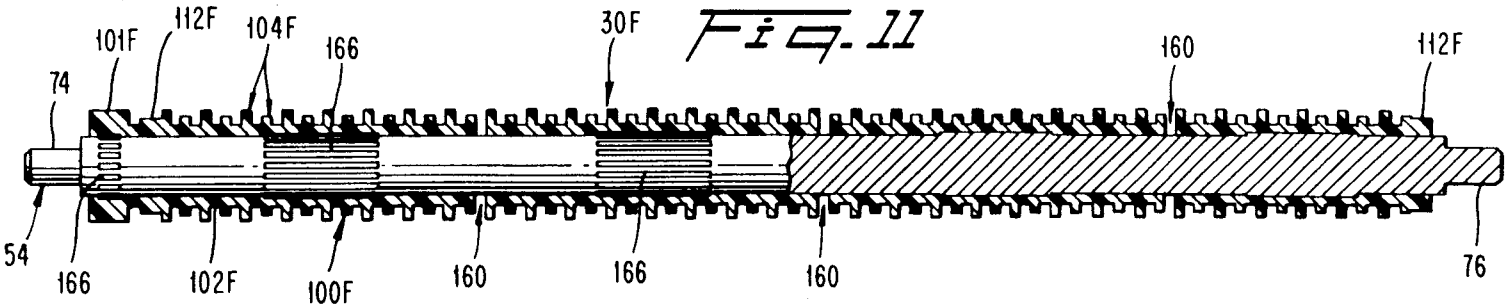
FIG. 11 is a longitudinal sectional view taken through an embossing roller according to the present invention.

In that regard, FIG. 10 depicts a molded roller assembly after removal from the mold. The assembly comprises the two embossing rollers 30F and 30R, each comprising a metal axle 52 (or 54) embedded within a plastic embossing portion 100F (or 100R). Each embossing portion is axially interrupted by three axial gaps 160 (see FIGS. 10, 11) so as to comprise four embossing segments $\mathbf{100F_1}$, $\mathbf{100F_2}$, $\mathbf{100F_3}$, $\mathbf{100F_4}$ (or $\mathbf{100R_1}$, $\mathbf{100R_2}$, $\mathbf{100R_3}$, $\mathbf{100R_4}$). Furthermore, the embossing segments of each roller are interconnected to each other and to the embossing segments of the other roller by a runner network 162. The runner network includes runner sections 164 leading directly to flats of respective embossing segments. By breaking-off the runner sections 164 at those flats, the rollers will be separated into the individual roller units 30F, 30R. Since the break-off occurs at the outer surfaces 110F (or 110R) of the flats, any flashing remaining on the embossing sections will not adversely affect an embossing action as might occur if such flashing were instead present on the outer surfaces of the paper-stressing knuckles.

The method of molding the rollers can be summarized as follows. The two metal (preferably steel) axles 52, 54 are placed within adjacent cavities of a mold (not shown). The mold cavities are interconnected by passages which, in turn, are connected to a common sprue. The axles are supported along their axes by means of spacers (not shown) which result in the formation of the gaps 160. Molten plastic, introduced via the sprue, fills the passages and cavities. The adherence of the plastic to the axles is enhanced by the presence of roughened or knurled areas 166 along the outer peripheries of the axles. After the plastic has hardened, the runners are separated from the rollers.

The plastic embossing portions 101R (or 101F) include integrally molded gears 101F (or 101R), depth rings 112F (or 112R), hub portions 102F (or 102R), and disks 104F (or 104R). The gears 101F, 101R are configured so that upon meshing of the gears, the disks of the mating rollers will be oriented to create a proper radial overlapping of the knuckles as the rollers rotate.

As noted earlier, since both rollers 30F, 30R of an associated roller pair are formed simultaneously of the same compound under identical temperature and pressure conditions, it is possible to achieve a high degree of dimensional precision. Furthermore, by forming each embossing portion 100F (or 100R) of axially interrupted sections $\mathbf{100F_1}$–$\mathbf{100F_4}$, the sections can cool and shrink independently of one another. If each of the embossing portions was instead formed of one piece, the center region might shrink at a different rate than the end regions, whereby proper dimensional tolerances would not be maintained. Shorter segments, however, are able to cool and shrink at a more uniform rate along their length. The segments are interconnected by the stiff metal axles which resist sagging of the rollers.

It will be appreciated that the present invention enables a rolled paper dispenser to carry economical flat paper which is dispensed in a softer, more absorbent condition, due to the formation of well-defined embossments thereon. The embossing rollers are configured and arranged to minimize the resistance to manual actuation due to such features as: the spacial relationship of the embossing disks on each roller and the spacial relationship between the disks of one roller relative to the other, the ability of the embossing rollers to axially self-adjust to a position of least resis- tance to paper travel, and the angularly offset relationship between the knuckles of the rollers which lessens the radial depth of knuckle meshing. Furthermore, the embossing mechanism can be easily incorporated, e.g., by retro-fit, within conventional hand-actuated dispensers. Due to the provision of a threading roller, the paper web can be fed automatically into the embossing nip to facilitate the replacement of paper rolls. The paper web effectively tracks the embossing rollers during travel through the nip, and leaves the nip in a relatively unwrinkled condition.

The embossing rollers themselves can be formed in a relatively economic manner since plastic material is utilized in their manufacture. Notwithstanding the use of plastic, the rollers are sag-resistant due to the stiff metal axles embedded within the plastic. By forming both rollers simultaneously in a common mold, the rollers will exhibit precise dimensional tolerances.

Although the present invention has been described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. A rolled paper embossing dispenser comprising:

a cabinet, means for rotatably supporting a roll of paper in said cabinet, a pair of embossing rollers rotatably mounted in said cabinet so as to form a nip therebetween through which the paper is discharged from said cabinet, said embossing rollers having parallel longitudinal axes spaced apart by a selected minimum spacing, each embossing roller comprising:

a plurality of axially successive hub portions having an outer periphery whose shortest distance from the respective axis defines a first distance, and a plurality of axially spaced disk portions alternating with said hub portions and defining recesses between one another, each disk portion including:

a plurality of circumferentially successively arranged knuckles having radially outermost peripheral surfaces, a shortest distance from the respective axis to each knuckle peripheral surface defining a second distance which is longer than said first distance, and a plurality of interconnecting surfaces each arranged to interconnect circumferentially adjacent ones of said knuckles, a shortest distance from each interconnecting surface to the respective axis defining a third distance which is longer than said first distance and shorter than said second distance, axially successive ones of said disks of each embossing roller being arranged in circumferentially offset relationship, said embossing rollers being arranged such that said disks of each embossing roller are situated radially opposite said recesses of the other roller, and such that said second distance is greater than one-half of said spacing between said axes, and said third distance is no greater than one-half of said spacing between the axes, and manually actuatable means for rotating said embossing rollers in unison whereby a paper web passing through said nip is pushed by said knuckles into recesses situated radially opposite said knuckles in a manner stretching the paper and forming embossments therein.

2. A rolled paper embossing dispenser according to claim 1, wherein the sum of said second and third distances is greater than said spacing between said axes.

3. A rolled paper embossing dispenser according to claim 1, wherein said third distance is less than one-half of said spacing between said axes.

4. A rolled paper embossing dispenser according to claim 1, wherein said interconnecting surfaces extend substantially linearly between two circumferentially adjacent knuckle peripheral surfaces.

5. A rolled paper embossing dispenser according to claim 1, wherein each of said disks contains from four to six knuckles.

6. A rolled paper embossing dispenser according to claim 1, wherein adjacent disks of each embossing roller are circumferentially offset by an angle equal in degrees to 360/2n, wherein n is the number of knuckles of each disk.

7. A rolled paper embossing dispenser according to claim 1, wherein an axial width of each recess is greater than an axial width of each disk, said rollers being arranged for limited relative axial play whereby said disks are able to freely travel axially from end of said recess to the other and assume a position offering the least resistance to roller rotation.

8. A rolled paper embossing dispenser according to claim 7, wherein said axial play comprises 20 to 30 percent of said recess width.

9. A rolled paper embossing dispenser according to claim 1, wherein each embossing roller comprises a metal axle embedded within a plastic embossing portion, said embossing portion being comprised of said hub and disk portions.

10. A rolled paper embossing dispenser according to claim 9, wherein each plastic embossing portion includes a gear and two depth rings, said gears of said rollers being in meshing engagement and said depth rings of said rollers being in mutual engagement to define said spacing between said axes.

11. A rolled paper embossing dispenser according to claim 1, wherein each embossing roller includes a gear and a depth ring, said gears being in meshing engagement and said depth rings being in mutual engagement to define said minimum spacing between said axes.

12. A rolled paper embossing dispenser according to claim 1, wherein said manually actuable means comprises a handle accessible externally of said cabinet.

13. A rolled paper embossing dispenser according to claim 1 including spring means yieldably urging said embossing rollers toward one another.

14. A rolled paper embossing dispenser according to claim 1 including a threading roller for threading a paper web into said nip, said threading roller being biased against said embossing rollers with a paper web situated between said threading roller and said nip, said threading roller being rotatable in response to rotation of said embossing rollers and including axially spaced fingers for pushing the paper web into said nip after a partial rotation of said threading roller.

15. A rolled paper embossing dispenser according to claim 14, wherein said fingers comprise axially spaced ribs extending circumferentially around a portion of an outer periphery of said threading roller whereby each rib defines opposite first and second ends, said threading roller being biased against both of said embossing rollers such that said ribs are situated opposite said disks of one embossing roller and said recesses of the other embossing roller, said threading roller being rotatable in response to rotation of said oppositely situated disks until one of said first and second ends of all of said ribs travel out of engagement with said oppositely situated disks, whereupon said ribs enter said oppositely situated recesses to force the paper web into said nip.

16. A rolled paper embossing dispenser according to claim 15 including stop means restricting rotation of said threading roller in one direction while permitting said threading roller to rotate in the opposite direction until said ribs travel out of engagement with said disks.

17. A rolled paper embossing dispenser according to claim 15 including means mounting said threading roller for movement between said position biased against said embossing rollers and a position spaced from said embossing rollers to enable the paper web to be interposed between said threading roller and said embossing rollers, and spring means for biasing said threading roller against said embossing rollers.

18. A rolled paper embossing dispenser according to claim 1, wherein said knuckles of one of said embossing rollers are angularly offset relative to said knuckles of the other embossing roller by an angle greater than zero degrees and no greater than about 10 degrees.

19. A rolled paper embossing dispenser according to claim 18, wherein said angle is about 7.5 degrees.

20. A rolled paper embossing dispenser comprising:
a cabinet,
means for rotatably supporting a roll of paper in said cabinet,
a pair of embossing rollers rotatably mounted in said cabinet so as to form a nip therebetween through which the paper is discharged from said cabinet, said embossing rollers having parallel longitudinal axes spaced apart by a selected minimum spacing, each embossing roller comprising:
a plurality of axially successive hub portions having an outer periphery whose shortest distance from the respective axis defines a first distance, and
a plurality of axially spaced disk port alternating with said hub portions and defining recesses between one another, each disk portion including:
a plurality of circumferentially successively arranged knuckles having radially outermost peripheral surfaces which are circumferentially elongated, a shortest distance from the respective axis to each knuckle peripheral surface defining a second distance which is longer than said first distance, and
a plurality of interconnecting surfaces each arranged to extend linearly and interconnect circumferentially adjacent ones of said knuckle peripheral surfaces, a shortest distance from each interconnecting surface to the respective axis defining a third distance which is longer than said first distance and shorter than said second distance,
axially successive ones of said disks of each embossing roller being arranged in circumferentially offset relationship, the angle of offset being equal in degrees to 360/2n, wherein n is the number of knuckles on each disk and wherein n is from four to six,
said embossing rollers being arranged such that said disks of each embossing roller are situated radially opposite said recesses of the other roller, and such that said second distance is greater than one-half of said spacing between said axes, and said third distance is no greater than one-half of said spacing between the axes, and the sum of said second and third distances is greater than said spacing between the axes,
an axial width of each recess being greater than an axial width of each disk, said rollers being arranged for limited relative axial play whereby said disks are able to freely travel axially from end of said recess to the other and assume a position offering the least resistance to roller rotation,
spring means yieldably urging said embossing rollers toward one another, and
manually actuable means for rotating said embossing rollers in unison whereby a paper web passing through said nip is pushed by said knuckles into recesses situated radially opposite said knuckles in a manner stretching the paper and forming embossments therein.

21. A rolled paper embossing dispenser according to claim 20, wherein each embossing roller- comprises a metal axle embedded within a plastic embossing portion, said embossing portion being comprised of said hub and disk portions and a gear and two depth rings, said gears of said rollers being in meshing engagement and said depth rings of said rollers being in mutual engagement to define said spacing between said axes.

22. A rolled paper embossing dispenser according to claim 20, wherein said knuckles of one of said embossing rollers are angularly offset relative to said knuckles of the other embossing roller by an angle greater than zero degrees and no greater than about 10 degrees.

23. A rolled paper embossing dispenser according to claim 22, wherein said angle is about 7.5 degrees.

24. A rolled paper embossing dispenser according to claim 20 including a threading roller for threading a paper web into said nip, said threading roller being biased against said embossing rollers with a paper web situated between said threading roller and said nip, said threading roller being rotatable in response to rotation of said embossing rollers and including axially spaced fingers for pushing the paper web into said nip after a partial rotation of said threading roller, said fingers comprising axially spaced ribs extending circumferentially around a portion of an outer periphery of said threading roller whereby each rib defines opposite first and second ends, said threading roller being biased against both of said embossing rollers such that said ribs are situated opposite said disks of one embossing roller and said recesses of the other embossing roller, said threading roller being rotatable in response to rotation of said oppositely situated disks until one of said first and second ends of all of said ribs travel out of engagement with said oppositely situated disks, whereupon said ribs enter said oppositely situated recesses to force the paper web into said nip, and means mounting said threading roller for movement between said position biased against said embossing rollers and a position spaced from said embossing rollers to enable the paper web to be interposed between said threading roller and said embossing rollers, and spring means for biasing said threading roller against said embossing rollers.

25. A rolled paper embossing dispenser according to claim 24 including stop means restricting rotation of said threading roller in one direction while permitting said threading roller to rotate in the opposite direction until said ribs travel out of engagement with said disks.

26. A rolled paper embossing dispenser comprising:
a cabinet,
means for rotatably supporting a roll of paper in said cabinet,
a pair of embossing rollers rotatably mounted in said cabinet so as to form a nip therebetween through which a paper web is discharged from said cabinet, said embossing rollers having parallel longitudinal axes spaced apart by a selected minimum spacing, each embossing roller comprising a plurality of axially spaced disk portions defining recesses between one another, said embossing rollers arranged such that said disk portions of each embossing roller are situated radially opposite respective recesses of the other embossing roller,
each of said disc portions including a plurality of circumferentially successively arranged knuckles, and a plurality of interconnecting surface each arranged to interconnect circumferentially adjacent ones of said knuckles, axially successive ones of said disc portions of each embossing roller being arranged in circumferentially offset relationship, the angle of offset being equal in degrees to 360/2n, wherein n is the number of knuckles on each disc, manually actuable means for rotating said embossing rollers in unison, and spring means yieldably urging said embossing rollers toward one another and permitting said embossing rollers to mutually separate to accommodate the passage of an enhanced thickness of paper through said nip in order to minimize the manual effort required to actuate said manually actuable means.

27. A rolled paper embossing dispenser comprising:

a cabinet, means for rotatably supporting a roll of paper in said cabinet, a pair of embossing rollers rotatably mounted in said cabinet so as to form a nip therebetween through which a paper web is discharged from said cabinet, said embossing rollers having parallel longitudinal axes spaced apart by a selected minimum spacing, each embossing roller comprising a plurality of axially spaced disk portions defining recesses between one another, said embossing rollers arranged such that said disks of each embossing roller are situated radially opposite respective recesses of the other embossing roller, manually actuable means for rotating said embossing rollers in unison, and a threading roller for threading the paper web into said nip, said threading roller being biased against both of said embossing rollers with a paper web situated between said threading roller and said nip, said threading roller being rotatable in response to rotation of said embossing rollers and including axially spaced fingers for pushing the paper web into said nip after a partial rotation of said threading roller.

28. A rolled paper embossing dispenser according to claim 27 including spring means yieldably urging said embossing rollers toward one another.

29. A rolled paper embossing dispenser according to claim 27, wherein said fingers comprise axially spaced ribs extending circumferentially around a portion of an outer periphery of said threading roller whereby each rib defines opposite first and second ends, said threading roller being biased against both of said embossing rollers such that said ribs are situated opposite said disks of one embossing roller and said recesses of the other embossing roller, said threading roller being rotatable in response to rotation of said oppositely situated disks until one of said first and second ends of all of said ribs travel out of engagement with said oppositely situated disks, whereupon said ribs enter said oppositely situated recesses to force the paper web into said nip.

30. A rolled paper embossing dispenser according to claim 29 including stop means restricting rotation of said threading roller in one direction while permitting said threading roller to rotate in the opposite direction until said ribs travel out of engagement with said disks.

31. A rolled paper embossing dispenser according to claim 27 including means mounting said threading roller for movement between said position biased against said embossing rollers and a position spaced from said embossing rollers to enable the paper web to be interposed between said threading roller and said embossing rollers, and spring means for biasing said threading roller against said embossing rollers.

32. A rolled paper embossing dispenser comprising:

a cabinet, means for rotatably supporting a roll of paper in said cabinet, a pair of embossing rollers rotatably mounted in said cabinet so as to form a nip therebetween through which the paper is discharged from said cabinet, said embossing rollers having parallel longitudinal axes spaced apart by a selected minimum spacing, each embossing roller comprising a plurality of axially spaced disk portions defining recesses between one another, each disk portion including:

a plurality of circumferentially successively arranged knuckles, and a plurality of interconnecting surfaces each arranged to interconnect circumferentially adjacent ones of said knuckles, axially successive ones of said disk portions of each embossing roller being arranged in circumferentially offset relationship, said embossing rollers being arranged such that said disk portions of each embossing roller are situated radially opposite said recesses of the other roller, and such that said knuckles of one embossing roller are angularly offset by an angle greater than zero degrees and no greater than about 10 degrees relative to said knuckles of the other embossing roller, and manually actuatable means for rotating said embossing rollers in unison whereby a paper web passing through said nip is pushed by said knuckles into recesses situated radially opposite said knuckles in a manner stretching the paper and forming embossments therein.

33. A rolled paper embossing dispenser according to claim 32, wherein said angle is about 7.5 degrees.

* * * * *